US006223414B1

(12) United States Patent
Hodek et al.

(10) Patent No.: US 6,223,414 B1
(45) **Date of Patent: *May 1, 2001**

(54) METHOD OF MAKING AN INSULATING UNIT HAVING A LOW THERMAL CONDUCTING SPACER

(75) Inventors: Robert Barton Hodek, Gibsonia; Thomas Patrick Kerr, Pittsburgh; Stephen C. Misera, Tarentum; William Randolph Siskos, Salem Township; Albert Edward Thompson, Jr., Allegheny Township, all of PA (US)

(73) Assignee: PPG Industries Ohio, Inc., Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/760,605

(22) Filed: Dec. 4, 1996

Related U.S. Application Data

(62) Division of application No. 08/412,028, filed on Mar. 28, 1995, now Pat. No. 5,655,282, which is a continuation of application No. 08/086,286, filed on Jul. 1, 1993, now abandoned, which is a division of application No. 07/686,956, filed on Apr. 18, 1991, now abandoned, which is a continuation-in-part of application No. 07/578,696, filed on Sep. 4, 1990, now abandoned.

(51) Int. Cl.[7] ..... B21B 1/46

(52) U.S. Cl. ..... 29/527.1; 29/527.4; 52/786.13; 428/34

(58) Field of Search ..... 29/527.1, 527.4, 29/897.312, 428; 52/786.13, 786.11, 658, 745.15; 428/34; 72/181, 177

(56) References Cited

U.S. PATENT DOCUMENTS

| | | |
|---|---|---|
| 1,836,354 | 12/1931 | Abrams . |
| 1,877,336 | 9/1932 | Lovell et al. . |
| 2,086,225 | 7/1937 | Hiering . |

(List continued on next page.)

FOREIGN PATENT DOCUMENTS

| | | |
|---|---|---|
| 481423 | 5/1977 | (AU) . |
| 493482 | 5/1978 | (AU) . |
| 206 130 | 11/1959 | (DE) . |

(List continued on next page.)

OTHER PUBLICATIONS

"IBM Technical Disclosure Bulletin" vol. 11, No. 2, Jul. 1968.
"Super Spacer™", Edgetech I.G. Ltd., May 1988.
Glover et al.; "Super Spacer™ Technical Report", Edgetech I.G. Ltd., May 1988.

(List continued on next page.)

*Primary Examiner*—S. Thomas Hughes
*Assistant Examiner*—John C. Hong
(74) *Attorney, Agent, or Firm*—Donald C. Lepiane

(57) ABSTRACT

A method of fabricating an insulating unit includes the steps of: providing a pair of sheets and a substrate; forming the substrate into at least one spacer section having a base and a pair of outer legs connected to the base, the spacer section having a surface designated as a supporting surface; providing a bead on the supporting surface, the bead provided on the supporting surface includes a moisture pervious adhesive having a desiccant therein and assembling a spacer frame that includes the at least one spacer section and the sheets provide an insulating unit having the pair of sheets in a fixed relationship.

34 Claims, 5 Drawing Sheets

U.S. PATENT DOCUMENTS

| | | | | |
|---|---|---|---|---|
| 2,097,927 | | 11/1937 | Klemp . | |
| 2,149,882 | | 3/1939 | Clements . | |
| 2,173,664 | | 9/1939 | Shutts . | |
| 2,219,595 | | 10/1940 | Lang . | |
| 2,235,680 | | 3/1941 | Haven et al. . | |
| 2,348,307 | | 5/1944 | Richardson . | |
| 2,587,063 | | 2/1952 | Petsch . | |
| 2,625,717 | | 1/1953 | Wampler et al. . | |
| 2,708,774 | | 5/1955 | Seelen . | |
| 2,750,637 | | 6/1956 | Browne . | |
| 2,768,475 | | 10/1956 | Seelen et al. . | |
| 2,831,244 | | 4/1958 | Adell . | |
| 2,885,746 | | 5/1959 | Gura | 20/56.5 |
| 2,974,377 | | 3/1961 | Kunkle . | |
| 2,977,722 | | 4/1961 | Mazzoni | 49/82 |
| 3,021,243 | | 2/1962 | Bethge . | |
| 3,026,582 | | 3/1962 | Bayer . | |
| 3,030,673 | | 4/1962 | London . | |
| 3,045,297 | | 7/1962 | Ljungdahl . | |
| 3,054,153 | | 9/1962 | Partsch . | |
| 3,105,274 | | 10/1963 | Armstrong . | |
| 3,212,179 | | 10/1965 | Koblensky . | |
| 3,267,569 | | 8/1966 | Eichhorn et al. . | |
| 3,280,523 | | 10/1966 | Stroud et al. . | |
| 3,283,890 | | 11/1966 | Morris et al. . | |
| 3,333,334 | * | 8/1967 | Kuliczkowski et al. | 29/527.1 X |
| 3,406,054 | | 10/1968 | Chaffee . | |
| 3,427,366 | | 2/1969 | Verdol et al. . | |
| 3,445,436 | | 5/1969 | Lake et al. . | |
| 3,478,483 | | 11/1969 | Baker . | |
| 3,657,900 | | 4/1972 | Bowser et al. . | |
| 3,674,743 | | 7/1972 | Verdol et al. . | |
| 3,758,996 | | 9/1973 | Bowser . | |
| 3,768,223 | | 10/1973 | Kurz . | |
| 3,771,276 | | 11/1973 | Stewart et al. . | |
| 3,775,914 | | 12/1973 | Patril . | |
| 3,832,254 | | 8/1974 | Bowser et al. | 156/107 |
| 3,867,107 | | 2/1975 | Long et al. . | |
| 3,877,275 | | 4/1975 | Attwood . | |
| 3,911,554 | | 10/1975 | Ford . | |
| 3,919,023 | * | 11/1975 | Bowser et al. | 156/107 |
| 3,923,748 | | 12/1975 | Hutt et al. . | |
| 3,935,683 | | 2/1976 | Derner et al. . | |
| 3,974,823 | | 8/1976 | Patil . | |
| 4,015,394 | | 4/1977 | Kessler . | |
| 4,057,945 | | 11/1977 | Kessler . | |
| 4,063,002 | | 12/1977 | Wilson, Jr. . | |
| 4,069,630 | | 1/1978 | Chess et al. . | |
| 4,109,431 | | 8/1978 | Mazzoni et al. . | |
| 4,132,539 | | 1/1979 | Jeffries . | |
| 4,153,594 | | 5/1979 | Wilson, Jr. . | |
| 4,222,213 | | 9/1980 | Kessler . | |
| 4,269,255 | | 5/1981 | Nailor et al. . | |
| 4,270,688 | | 6/1981 | Janssens et al. . | |
| 4,318,959 | | 3/1982 | Evans et al. . | |
| 4,350,515 | | 9/1982 | Stewart . | |
| 4,431,691 | | 2/1984 | Greenlee . | |
| 4,464,874 | | 8/1984 | Shea, Jr. et al. . | |
| 4,520,611 | | 6/1985 | Shingu et al. . | |
| 4,546,723 | | 10/1985 | Leopold et al. . | |
| 4,574,553 | | 3/1986 | Lisec . | |
| 4,581,807 | * | 4/1986 | Adell | 29/527.4 |
| 4,590,240 | | 5/1986 | Streeter et al. . | |
| 4,597,232 | | 7/1986 | Lingemann . | |
| 4,610,771 | | 9/1986 | Gillery . | |
| 4,622,249 | | 11/1986 | Bowser . | |
| 4,649,685 | | 3/1987 | Wolf et al. . | |
| 4,780,164 | | 10/1988 | Rueckheim et al. . | |
| 4,780,521 | | 10/1988 | Duck et al. . | |
| 4,806,220 | | 2/1989 | Finley . | |
| 4,807,419 | | 2/1989 | Hodek et al. . | |
| 4,807,439 | | 2/1989 | Hain et al. . | |
| 4,808,452 | | 2/1989 | McShane . | |
| 4,817,354 | | 4/1989 | Bayer . | |
| 4,831,799 | * | 5/1989 | Glover et al. | 52/172 |
| 4,850,175 | | 7/1989 | Berdan . | |
| 4,853,256 | | 8/1989 | Obringer et al. . | |
| 4,853,257 | | 8/1989 | Henery . | |
| 4,873,803 | | 10/1989 | Rundo . | |
| 4,933,032 | | 6/1990 | Kunert . | |
| 4,950,344 | | 8/1990 | Glover et al. . | |
| 4,952,430 | | 8/1990 | Bowser et al. . | |
| 4,969,250 | | 11/1990 | Hickman et al. . | |
| 4,969,346 | | 11/1990 | Bosl et al. . | |
| 4,994,309 | | 2/1991 | Reichert et al. . | |
| 5,088,258 | | 2/1992 | Schield et al. . | |
| 5,156,894 | | 10/1992 | Hood et al. . | |
| 5,177,916 | | 1/1993 | Misera et al. . | |
| 5,246,331 | | 9/1993 | Hallahan et al. . | |
| 5,255,481 | | 10/1993 | Misera et al. . | |
| 5,377,473 | | 1/1995 | Narayan et al. | 52/790 |
| 5,501,013 | * | 3/1996 | Misera et al. | 29/897.312 |
| 5,531,047 | | 7/1996 | Leopold et al. | 52/172 |
| 5,761,946 | * | 6/1998 | Misera et al. | 72/181 |

FOREIGN PATENT DOCUMENTS

| | | | | |
|---|---|---|---|---|
| 1918528 | | 11/1970 | (DE) . | |
| 2619718 | | 11/1977 | (DE) . | |
| 30 40 407 | | 10/1979 | (DE) . | |
| 2923769 | | 1/1980 | (DE) . | |
| 80 17 644 | | 10/1980 | (DE) . | |
| 3044179 | | 6/1982 | (DE) . | |
| 3302659 | | 8/1984 | (DE) . | |
| 8201396 | | 10/1984 | (DE) . | |
| 0 241 665 | | 10/1987 | (EP) . | |
| 0 261 923 | | 3/1988 | (EP) . | |
| 0 328 823 | | 8/1989 | (EP) . | |
| 0 430 889 | | 11/1990 | (EP) . | |
| 0 403 058 | | 12/1990 | (EP) . | |
| 639955 | | 7/1950 | (GB) . | |
| 898981 | | 6/1962 | (GB) . | |
| 1509178 | | 4/1978 | (GB) . | |
| 1585544 | | 3/1981 | (GB) . | |
| 2202261 | | 9/1988 | (GB) . | |
| 0014436 | * | 1/1982 | (JP) | 29/527.1 |
| 57-14436 | * | 1/1982 | (JP) . | |
| 121019 | | 3/1960 | (NZ) . | |
| 206499 | | 8/1988 | (NZ) . | |
| 223888 | | 10/1990 | (NZ) . | |
| WO91/00409 | | 1/1991 | (WO) . | |

OTHER PUBLICATIONS

Wright et al., "Thermal Resistance Measurement of Glazing System Edge–Seals and Seal Materials Using a Guarded Heater Plate Apparatus", Nov. 1989.

"Superglass™ System With Heat Mirror Film", Jan. 1990.

"Introducing Super Spacer™ PIB", Sep. 1, 1990.

"What Is Warm Edge Technology"; Glass Digest, pp. 74–76; Mar. 1991.

Advertisement from Lockformer Company (no date).

* cited by examiner

METHOD OF MAKING AN INSULATING UNIT HAVING A LOW THERMAL CONDUCTING SPACER

This is a division of application Ser. No. 08/412,028, filed Mar. 28, 1995, now U.S. Pat. No. 5,655,282, which is a file wrapper continuation of application Ser. No. 08/086,286, filed on Jul. 1, 1993, now abandoned, which is a division of application Ser. No. 07/686,956, filed Apr. 18, 1991, now abandoned, which is a continuation-in-part of application Ser. No. 07/578,696, filed on Sep. 4, 1990, now abandoned.

The unit taught in this application may be fabricated using the spacer and spacer frame disclosed in U.S. patent application Ser. No. 07/578,697 filed on Sep. 4, 1990, in the names of Stephen C. Misera and William Siskos and entitled A SPACER AND SPACER FRAME FOR AN INSULATING GLAZING UNIT AND METHOD OF MAKING SAME.

BACKGROUND OF THE INVENTION

1. Field of the Invention

This invention relates to an insulating glazing unit and a method of making same and, in particular, to an insulating glazing unit having an edge assembly to provide the unit with a low thermal conducting edge, i.e. high resistance to heat flow at the edge of the unit.

2. Discussion of Available Insulating Units

It is well recognized that insulating glazing units reduce heat transfer between the outside and inside of a home or ether structures. A measure of insulating value generally used is the "U-value". The U-value is the measure of heat in British Thermal Unit (BTU) passing through the unit per hour (Hr)–square foot (Sq.Ft.)–degree Fahrenheit (° F.)

$$\left(\frac{\text{BTU}}{\text{Hr-Sq. Ft. °F.}}\right).$$

As can be appreciated the lower the U-value the better the thermal insulating value of the unit, i.e. higher resistance to heat flow resulting in less heat conducted through the unit. Another measure of insulating value is the "R-value" which is the inverse of the U-value. Still another measure is the resistance (RES) to heat flow which is stated in Hr–° F. per BTU per inch of perimeter of the unit $$\left(\frac{\text{Hr-°F.}}{\text{BTU/in}}\right).$$

In the past the insulating property, e.g. U-value given for an insulating unit was the U-value measured at the center of the unit. Recently it has been recognized that the U-value of the edge of the unit must be considered separately to determine the overall thermal performance of the unit. For example, units that have a low center U-value and high edge U-value during the winter season exhibit no moisture condensation at the center of the unit, but may have condensation or even a thin line of ice at the edge of the unit near the frame. The condensation or ice at the edge of the unit indicates that there is heat loss through the unit and/or frame i.e. the edge has a high U-value. As can be appreciated, when the condensate or water from the melting ice runs down the unit onto wooden frames, the wood, if not properly cared for, will rot. Also, the larger temperature differences between the warm center and the cold edge can cause greater edge stress and glass breakage. The U-values of framed and unframed units and methods of determining same are discussed in more detail in the section entitled "Description of the Invention."

Through the years, the design of and construction materials used to fabricate insulating glazing units, and the frames have improved to provide framed units having low U-values. Several types of units presently available, and center and edge U-values of selected ones, are considered in the following discussion.

Insulating glass edge units which are characterized by (1) the edges of the glass sheets welded together, (2) a low emissivity coating on one sheet and (3) argon in the space between the sheets are taught, among other places, in U.S. patent application Ser. No. 07/468,039 assigned to PPG Industries, Inc. filed on Jan. 22, 1990, in the names of P. J. Kovacik et al. and entitled "Method of and Apparatus for Joining Edges of Glass Sheets, One of Which Has an Electroconductive Coating and the Article Made Thereby." The units taught therein have a measured center U-value of about 0.25 and a measured edge U-value of about 0.55. Although insulating units of this type are acceptable, there are limitations. For example, special equipment is required to heat and fuse the edges of the glass sheets together, and tempered glass is not used in the construction of the units.

In U.S. Pat. No. 4,807,439 there is taught an insulting unit marketed by PPG Industries, Inc. under the registered trademark SUNSEAL. The unit has a pair of glass sheets spaced about 0.45 inch (1.14 centimeters) apart about an organic edge assembly and air in the compartment between the sheets. A unit so constructed is expected to have a measured center U-value of about 0.35 and an edge U-value of about 0.59. Although providing insulating gas e.g. argon in the unit would lower the center and edge U-values, the argon in time would diffuse through the organic edge assembly raising the center and edge U-values to those values previously stated.

The unit of U.S. Pat. No. 4,831,799 has an organic edge assembly and a gas barrier coating, sheet or film at the peripheral edge of the unit to retain argon in the unit. The thermal performance of the unit is discussed in column 5 of the patent. U.S. Pat. Nos. 4,431,691 and 4,873,803 each teach a unit having a pair of glass sheets separated by an edge assembly having an organic bead having a thin rigid member embedded therein. Although the units of these patents have acceptable U-values, they have drawbacks. More particularly, the units have a short length, high resistance diffusion path. The diffusion path is the distance that gas, e.g. argon, air, or moisture has to travel to exit or enter the compartment between the sheets. The resistance of the diffusion path is determined by the permeability, thickness and length of the material. The units taught in U.S. Pat. Nos. 4,831,799; 4,431,691 and 4,873,803 have a high resistance, short diffusion path between the metal strip or spacing means and the glass sheets; the remainder of the edge assembly has a low resistance, long length diffusion path.

In U.S. Pat. No. 3,919,023, there is taught an edge assembly for an insulating unit that provides a high resistance, long length diffusion path that may be used to minimize the loss of argon. A limitation of the edge assembly of the patent is the use of a metal strip around the outer marginal edges of the unit. This metal strip conducts heat around the edge of the unit, and the unit is expected to have a high edge U-value.

It was mentioned that the effect of the frame U-value on the window edge U-value should be taken into account;

however, a detailed discussion of frames having low U-value is omitted because the instant invention is directed to an insulating glazing unit that has low center and edge U-values, is easy to construct, does not have the limitations or drawbacks of the presently available insulating glazing units, and may be used with any frame construction.

SUMMARY OF THE INVENTION

The invention covers an insulating unit having a pair of glass sheets separated by an edge assembly to provide a sealed compartment between the sheets having a gas therein. The edge assembly includes a spacer that is structurally sound to maintain the glass sheets in a fixed spaced relationship and yet accommodates a certain degree of thermal expansion and contraction which typically occurs in the several component parts of the insulating glazing unit. A diffusion path having resistance to the gas in the compartment e.g. a long thin diffusion path, is provided between the spacer and the glass sheets, and the edge assembly has a high RES value at the unit edge as determined using the ANSYS program.

The invention also covers a method of making an insulating unit. The method includes the steps of providing an edge assembly between a pair of glass sheets to provide a compartment therebetween. The edge assembly is fabricated by providing a pair of glass sheets; selecting a structurally resilient spacer, sealant materials and moisture pervious desiccant containing material to provide an edge assembly having a high RES as determined using the ANSYS program and a long thin diffusion path. The glass sheets, spacer, sealant material and desiccant containing materials are assembled to provide an insulating unit having a high RES at the edge as measured using the ANSYS program.

The preferred insulating unit of the invention has an environmental coating, e.g. a low-E coating on at least one sheet surface. Adhesive sealant on each of the outer surfaces of the spacer having a "U-shaped" cross section secures the sheets to the spacer. A strip of moisture pervious adhesive having a desiccant is provided on the inner surface of the spacer.

Further, the invention covers a spacer that may be used in the insulating unit. The spacer includes a structurally resilient core e.g. a plastic core having a moisture/gas impervious film e.g. a metal film or a halogenated polymeric film such as polyvinylidene chloride or flouride or polyvinyl chloride or polytrichlorofluoro ethylene.

Additionally, the spacer may be made entirely from a polymeric material having both structural resiliency and moisture/gas impervious characteristics such as a halogenated polymeric material including polyvinylidene chloride or flouride or polyvinyl chloride or polytrichlorofluoro ethylene.

DESCRIPTION OF THE INVENTION

Figure 20:
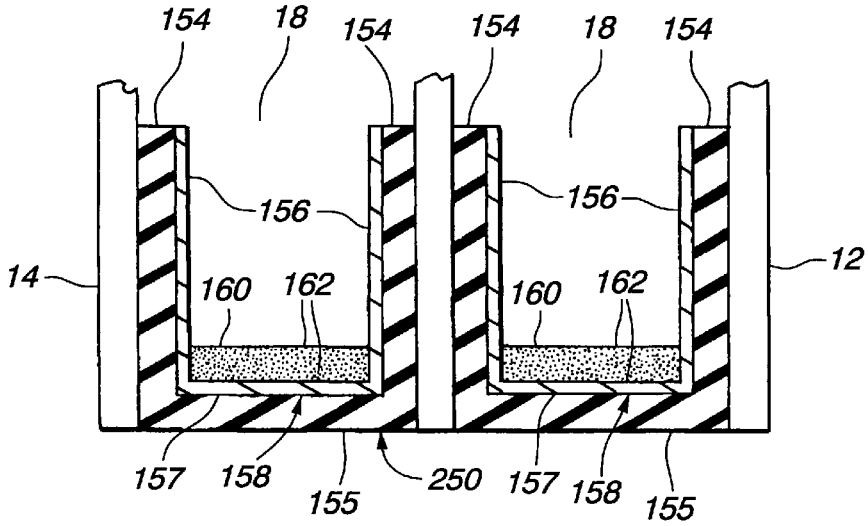
FIG. 20 is a view similar to the view of FIG. 10 showing another embodiment of the invention.

In the following discussion like numerals refer to like elements, and the units are described having two glass sheets; however, as is appreciated by those skilled in the art, units with more than two sheets as shown in FIG. 20 are also contemplated.

With reference to FIGS. 1–4 there are shown four general types of prior art edge assemblies used in the construction of insulated glazing units. Unit 10 of FIG. 1 includes a pair of glass sheets 12 and 14 spaced from one another by an edge assembly 16 to provide a compartment 18 between the sheets. The edge assembly 16 includes a hollow metal spacer 20 having a desiccant 22 therein to absorb any moisture in the compartment and holes 23 (only one shown in FIG. 1) providing communication between the desiccant and the compartment. The edge assembly 16 further includes an adhesive type sealant 24 e.g. silicon at the lower section of the spacer 20 as viewed in FIG. 1 to secure the spacer 20 and the glass sheets together and a sealant 25 e.g. a butyl sealant at the upper section of the spacer 20 to prevent the egress of insulating gas in the compartment 18. The edge assembly 16 of the unit 10 is similar to the type of units sold by Cardinal Glass and also similar to the insulating units taught in U.S. Pat. Nos. 2,768,475; 3,919,023; 3,974,823; 4,520,611 and 4,780,164 which teachings are hereby incorporated by reference.

Figure 1:
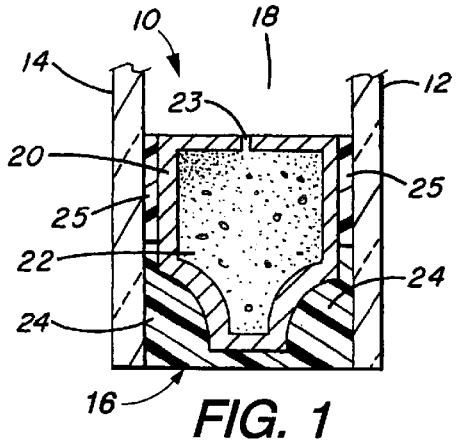
FIG. 1 PRIOR ART
FIGS. 1 thru 4 are cross sectional views of edge assemblies of prior art insulating units.
Figure 2:
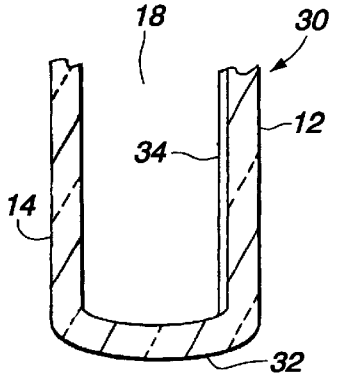
FIG. 2 PRIOR ART

Unit 30 in FIG. 2 includes the glass sheets 12 and 14 having their edges welded together at 32 to provide the compartment 18. One of the glass sheets e.g. sheet 12 has a low emissivity coating 34. The unit 30 shown in FIG. 2 is similar to the insulating units sold by PPG Industries, Inc. under its trademark OptimEdge and is also similar to the units taught in U.S. Pat. Nos, 4,132,539 and 4,350,515 and in U.S. patent application Ser. No. 07/468,039 filed on Jan. 22, 1990, discussed above, which teachings are hereby incorporated by reference.

Figure 3:
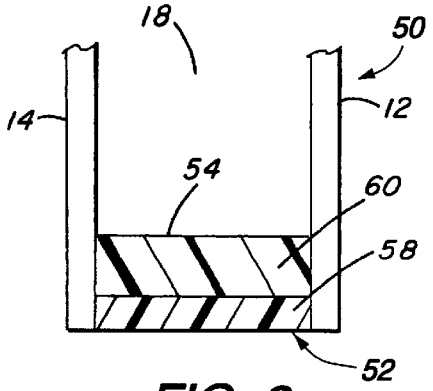
FIG. 3 PRIOR ART

With reference to FIG. 3 there is shown unit 50 taught in U.S. Pat. No. 4,831,799, which teachings are hereby incorporated by reference. The unit 50 has the glass sheets 12 and 14 separated by an edge assembly 52 to provide the compartment 18. The edge assembly 52 includes a moisture pervious foam material 54 having a desiccant (not shown in FIG. 3) similar to desiccent 76 shown in FIG. 4 therein to absorb moisture in the compartment 18, a moisture impervious sealant 58 to prevent moisture in the air from moving into the compartment 18 and a gas barrier coating, sheet or film 60 between the foam material 54 and sealant 58 to prevent egress of the insulating gas in the compartment 18. Units similar to the unit 50 are taught in U.S. Pat. No. 4,807,419 which teachings are hereby incorporated by reference.

Figure 4:
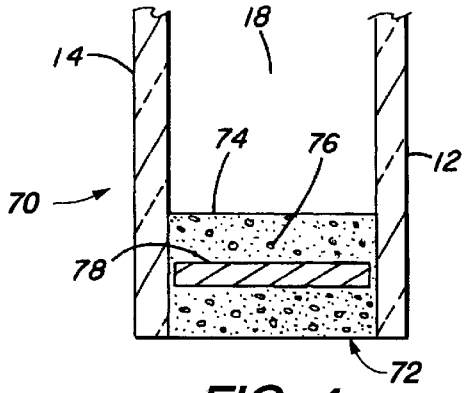
FIG. 4 PRIOR ART

In FIG. 4 there is shown unit 70 taught in U.S. Pat. Nos. 4,431,691 and 4,873,803 which teachings are hereby incorporated by reference. The unit 70 has the glass sheets 12 and 14 separated by an edge assembly 72 to provide the compartment 18. The edge assembly 72 includes a moisture pervious adhesive 74 having a desiccant 76 and a metal member 78 therein.

Before teaching the construction of the insulating unit, more particularly the edge assembly of the instant invention, a discussion of the heat transfer through an insulated unit is deemed appropriate to fully appreciate the instant invention. In the following discussion the U-value will be used to compare or rate heat transfer i.e. resistance to heat flow through a glazing unit to reduce heat loss. As is appreciated by those skilled in the art the lower the U-value the less heat transfer and vice versa. The U-value for an insulating unit can be determined from the following equation.

$$Ut=(Ac/At)Uc+(Ae/At)Ue+(Af/At)Uf \quad (1)$$

where

U is the measure of heat transfer in British Thermal Unit/hour-square foot-° F. (BTU/Hr-Sq.Ft.-° F.)

Figure 5:
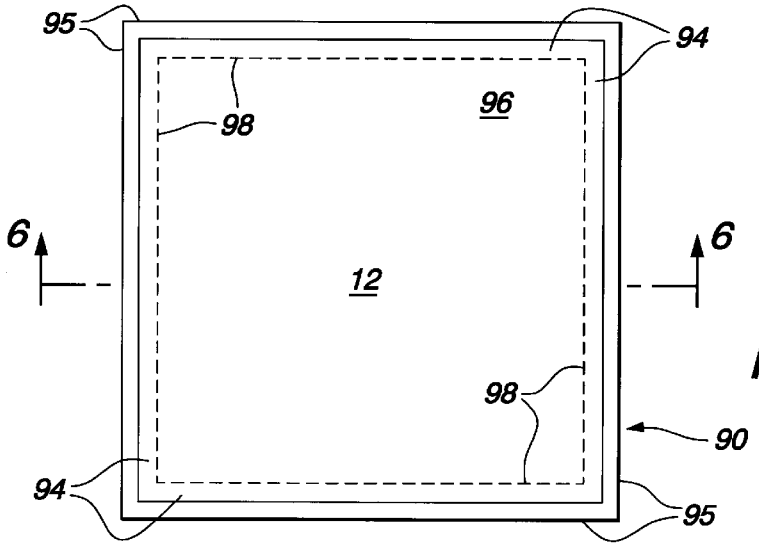
FIG. 5 is a plan view of an insulating unit having a generic spacer assembly.
Figure 6:
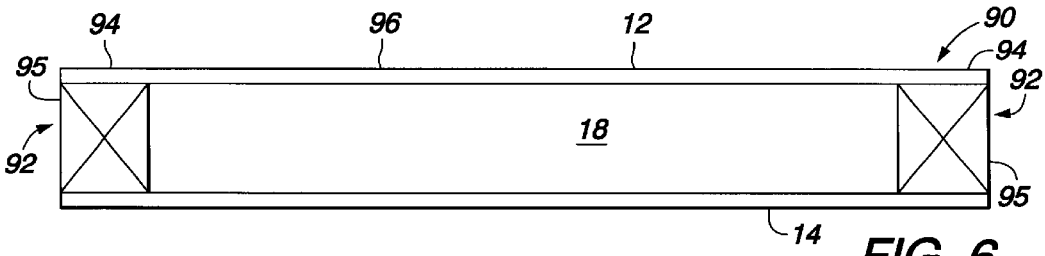
FIG. 6 is a view taken along lines 6—6 of FIG. 5.

A is area under consideration in square feet c designates the center of the unit e designates the edge of the unit f designates the frame t is total unit value of the parameter under discussion Shown in FIGS. 5 and 6 is a generic insulating unit 90 having the glass sheets 12 and 14 separated by an edge assembly 92 to provide the compartment 18. The edge assembly 92 is considered for the purposes of this discussion a generic edge assembly and is not limited by design. With specific reference to FIG. 5, the unit 90 for purposes of the discussion has an edge area 94 which is the area between the peripheral edge 95 of the unit and a position about 3.0 inches (7.62 centimeters) in from the peripheral edge, and a central area 96. The interface between the edge area 94 and center area 96 of the unit 90 is shown in FIG. 5 by dotted lines 98.

Figure 7:
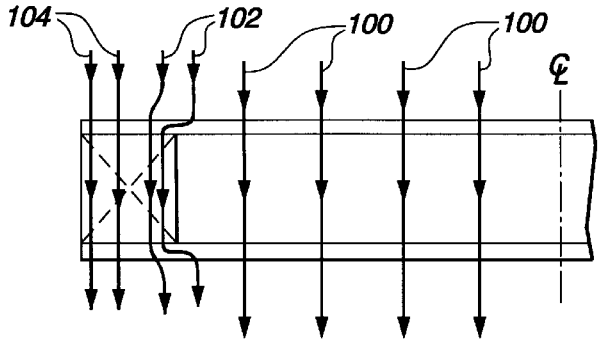
FIG. 7 is the left half of the view of FIG. 6 showing heat flow lines through the unit.

The left half of unit 90 shown in FIG. 6 is shown in FIG. 7 having the numerals removed for purposes of clarity during the following discussion relating to heat transfer through the unit. With reference to FIGS. 5, 6 and 7 as required, during the winter season, heat from inside an enclosure e.g. a house moves through the edge area 94 and center area 96 of the unit 90 to the outside. Referring now to FIG. 7, at the center area 96 of the unit, the heat flow pattern is generally perpendicular to the isotherm which is the major surfaces of the glass sheets 12 and 14 and is illustrated in FIG. 7 by arrowed lines 100. The direction of the heat flow pattern changes as the peripheral edge 95 of the unit is approached as illustrated by arrowed lines 102, until at the peripheral edge 95 of the unit the heat flow pattern is again perpendicular to the major surface of the glass sheets as illustrated by arrowed lines 104. As can be appreciated by those skilled in the art, a frame mounted about the periphery of the unit has an effect on the flow patterns, in particular, flow patterns 102 and 104. For purposes of this discussion the effect of the frame on flow patterns 102 and 104 is omitted, and the above discussion is considered sufficient to provide a background to appreciate the instant invention.

The heat flow through the center area 96 of the unit 90 may be modified by changes in the thermal properties of sheets 12 and 14, the distance between the sheets and gas in the compartment 18. Consider now the distance between the sheets i.e. the compartment spacing. Compartments having a spacing between about 0.250–0.500 inch (0.63–1.27 centimeters) are considered acceptable to provide an insulating gas layer with the preferred spacing depending on the insulating gases used. Krypton gas is preferred at the low range, air and argon are preferred at the upper range. In general, below 0.250 inch (0.63 centimeter) the spacing is not wide enough e.g. for air or argon gas to provide a significant insulating gas layer and above 0.500 inch (1.27 centimeters), gas currents e.g. using krypton gas in the compartment have sufficient mobility to allow convection thereby moving heat between the glass surfaces, e.g. between the glass surface facing the house interior to the glass surface facing the house exterior.

As previously mentioned, heat flow through the unit may also be modified by the type of gas used in the compartment. For example, using a gas that has a high thermal insulating value increases the performance of the unit, in other words it decreases the U-value at the center and edge areas of the unit. By way of example, but not limiting to the invention, argon has a higher thermal insulating value than air. Everything else relating to the construction of the unit being equal, using argon would lower the U-value of the unit.

Another technique to modify the thermal insulating value of the center area is to use sheets having high thermal insulating values and/or sheets having low emissivity coatings. Types of low emissivity coatings that may be used in the practice of the invention are taught in U.S. Pat. Nos. 4,610,771; 4,806,220; and 4,853,256 which teachings are hereby incorporated by reference. Also increasing the number of glass sheets increases the number of compartments thereby increasing the insulating effect at the center and edge areas of the unit.

Figure 8:
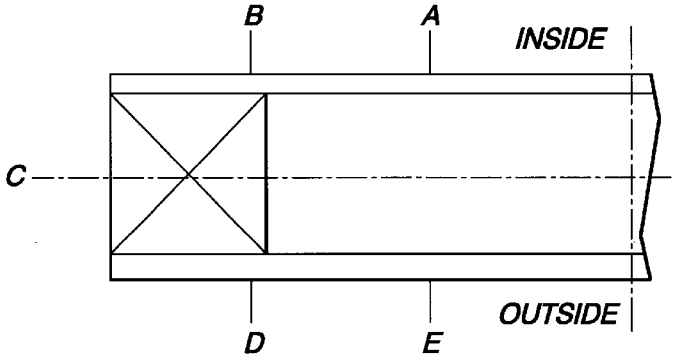
FIG. 8 is a view similar to the view of FIG. 7 having the heat flow lines removed.
Figure 9:
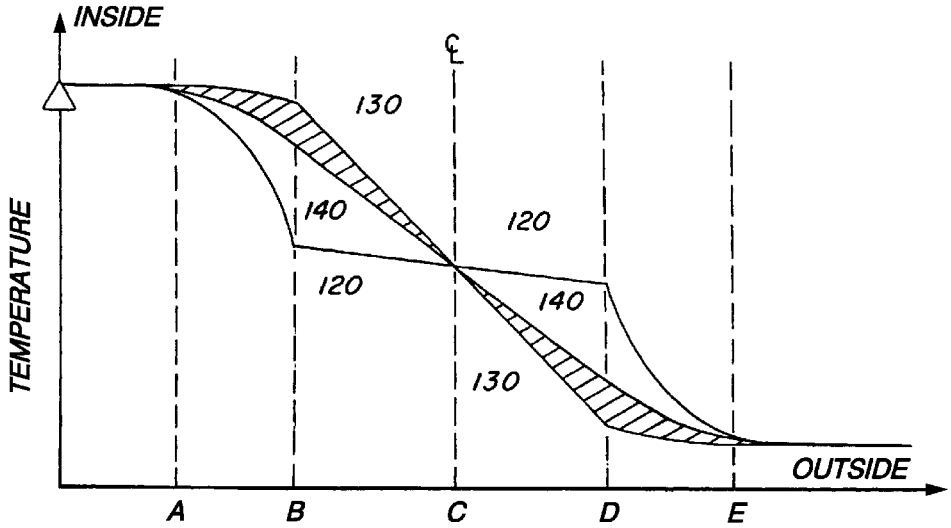
FIG. 9 is a graph showing edge temperature distribution for units having various type of edge assemblies.

The discussion will now be directed to the thermal loss at the edge area of the unit. With reference to FIG. 8 there is shown an edge portion of the unit 90 shown in FIGS. 5 and 6. The letters A and E are the points where heat flow is generally perpendicular to the glass surfaces. As the edge of the unit is approached the glass begins to act as an extended surface relative to the edge and causes the heat flow paths 100 to curve or bend at the edge of the unit as illustrated in FIG. 7 by numerals 102. This curvature occurs in the edge area 94 shown in FIGS. 6 and 7. Between the letters B and D the flow of heat is primarily resisted by the edge assembly 92 rather than the glass at the unit edge. With reference to FIG. 9 curves 120, 130 and 140 show the edge heat loss for different types of edge assemblies. FIG. 9 should not be interpreted as an absolute relationship but as a general guide to better understand the heat flow through the edge assembly. Curve 120 illustrates the heat loss pattern for an edge assembly that is highly heat conductive e.g. an aluminum spacer generally used in the construction of edge assemblies of the types shown in FIG. 1. Curve 130 illustrates the heat loss pattern for an edge assembly that is less heat conductive than an edge assembly having an aluminum spacer e.g. an edge assembly having a plastic spacer similar to the construction of the edge assembly shown in FIG. 3. Line 140 illustrates the edge heat loss pattern for a glass edge unit of the type shown in FIG. 2. Although not limiting to the invention, the edge assembly incorporating features of the invention is expected to provide a heat loss pattern similar to curve 140 and heat loss patterns within the shaded areas between curves 130 and 140.

As can be seen in FIG. 9, the profile for an aluminum spacer represented by the curve 120 shows that the aluminum spacer at the edge of the unit (between points A and C) offers little resistance to heat flow thus allowing a cooler edge at the surface of the unit inside the house. The profile for an organic e.g. polymeric spacer represented by the curve 130 shows the organic spacer to have a high resistance to heat flow allowing for a warmer glass surface inside the house resulting in reduced heat loss at the edge of the unit. This is particularly illustrated by the curve 130 between points A and C. Edges of welded glass sheets e.g. as shown in FIG. 2 offer more resistance than the metal type spacer assembly but less than the plastic type edge assembly. The temperature distribution of edge welded units between points A and C is represented by the line 140 which is between lines 120 and 130 between points A and C on the graph of FIG. 9.

The heat loss for an edge assembly using a metal spacer, in particular an aluminum spacer is greater than for glass because the aluminum spacer has a higher thermal conductivity (aluminum is a better conductor of heat than glass or organic materials). The effect of the higher thermal conductivity of the aluminum spacer is also evident at point D which shows the curve 120 for the aluminum spacer to have a higher temperature than the curve 140 or the curve 130 at the outside surface of the unit. The heat to maintain the higher temperature at D for the aluminum spacer is conducted from inside the house thereby resulting in a heat loss at the edge of the unit greater than the edge heat loss for units having glass or organic spacers, and greater than the edge assembly of the invention as will be discussed in detail below.

The heat loss for an edge assembly having an organic spacer is less than the heat loss for edge assemblies having metal spacers or welded glass because the organic spacer has a lower thermal conductivity. The effect of the lower thermal conductivity of the organic spacer is shown by line 130 at point D which has a lower temperature than the glass and metal spacers illustrating that conductive heat loss through the organic spacer is less than for glass and metal spacers.

A phenomenon of units having high edge heat loss is that on very cold days, a thin layer of condensation or ice forms at the inside of the unit at the frame. This ice or condensate may be present even though the center of the unit is free of moisture.

As was discussed, units that have argon in the compartment and polymeric edge assemblies may have an initial low U-value, but as time passes, the U-value increases because polymeric spacers as a general rule do not retain argon. To retain argon an additional film such as that taught in U.S. Pat. No. 4,831,799 is required. The drawback of the unit of this U.S. Pat. No. 4,831,799 is that the film has a short diffusion path as was discussed supra. As can be appreciated argon retention can be improved by selection of materials e.g. hot melt adhesive sealants such as HB Fuller 1191, HB Fuller 1081A and PPG Industries, Inc. 4442 butyl sealant retain argon better than most polyurethane adhesives.

Figure 10:
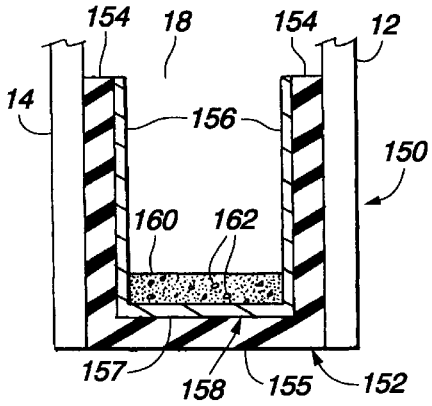
FIG. 10 is a sectional view of an edge assembly incorporating features of the invention.

With reference to FIG. 10 there is shown insulating unit 150 having edge assembly 152 incorporating features of the invention to space the glass sheets 12 and 14 to provide the compartment 18. The edge assembly 152 includes a moisture and/or gas impervious adhesive type sealant layer 154 to adhere the glass sheets 12 and 14 to legs 156 of metal spacer 158. The sealant layers 154 act as a barrier to moisture entering the unit and/or a barrier to gas e.g. insulating gas such as argon from exiting the compartment 18. With respect to the loss of the fill gas from the unit, in practice the length of the diffusion path and thickness of the sealant bead are chosen in combination with the gas permeability of sealant material so that the rate of loss of the fill gas matches the desired unit performance lifetime. The ability of the unit to contain the fill gas is measured using a European procedure identified as DIN 52293. Preferably, the rate of loss of the fill gas should be less than 5% per year and more preferably it should be less than 1% per year.

With respect to the ingress of moisture into the unit, the geometry of the sealant bead is chosen so that the amount of moisture permeating through the perimeter parts (i.e. sealant bead and spacer) is a quantity able to be absorbed into the quantity of desiccant within the unit over the desired unit lifetime. The preferred adhesive sealant to be used with the spacer of FIGS. 10 and 11 should have a moisture permeability of less than 20 gm mm/$M^2$ day using ASTM F 372-73. More preferably, the permeability should be less than 5 gm mm/$M^2$ day.

The relationship between the amount of desiccant in the unit and the permeability of the sealant (and its geometry) may be varied depending on the overall desired unit lifetime.

An additional adhesive sealant type layer or structural adhesive layer 155 e.g. but not limited to silicone adhesive and/or hot melts may be provided in the perimeter groove of the unit formed by middle leg 157 of the spacer and marginal edges of the glass sheets. As can now be appreciated the sealant is not limiting to the invention and may be any of the types known in the art e.g. the type taught in U.S. Pat. No. 4,109,431 which teachings are hereby incorporated by reference. A thin layer 160 of a moisture pervious adhesive having a desiccant 162 therein to absorb moisture in the compartment 18 is provided on the inner surface of the middle leg 157 of the spacer 158 as viewed in FIG. 10. The desiccant may also be placed along the inner surface of the legs 156 as well as the middle leg 157. The permeability of the adhesive layer 160 is not limiting to the invention but should be sufficiently permeable to moisture within compartment 18 so that the desiccant therein can absorb moisture within the compartment. Adhesive materials having a permeability of greater than 2 gm mm/$M^2$ day as determined by the above referred to ASTM F 372-73 may be used in the practice of the invention. The edge assembly 152 provides the unit 150 with a low thermal conductive path through the edge i.e. a high resistance to heat loss, a long diffusion path and structural integrity with sufficient structural resilience to accommodate a certain degree of thermal expansion and contraction which typically occurs in the several component parts of the insulating glazing unit.

To fully appreciate the high resistance to heat loss of the edge assembly of the instant invention, the following discussion of the mechanism of thermal conductivity through the edge of an insulated unit is presented.

The heat loss through an edge of a unit is a function of the thermal conductivity of the materials used, their physical arrangement, the thermal conductivity of the frame and surface film coefficient. Surface film coefficient is transfer of heat from air to glass at the warm side of the unit and heat transfer from glass to air on the cold side of the unit. The surface film coefficient depends on the weather and the environment. Since the weather and environment are controlled by nature and not by unit design, no further discussion is deemed necessary. The frame effect will be discussed later leaving the present discussion to the thermal conductivity of the materials at the unit edge and their physical arrangement.

The resistance of the edge of the unit to heat loss for an insulating unit having sheet material separated by an edge assembly is given by equation (2).

$$RHL=G_1+G_2+\ldots+G_n+S_1+S_2+\ldots+S_n \quad (2)$$

where

RHL is the resistance to edge heat loss at the edge of the unit in hour–° F./BTU/inch of unit perimeter (Hr–° F./BTU/in.)

G is the resistance to heat loss of a sheet in Hr–° F./BTU/in.

S is the resistance to heat loss of the edge assembly in Hr–° F./BTU/in.

For an insulating unit having two sheets separated by a single edge assembly equation (2) may be rewritten as equation (3).

$$RHL=G_1+G_2+S_1 \quad (3)$$

The thermal resistance of a material is given by equation (4).

$$R=L/KA \quad (4)$$

where

R is the thermal resistance in Hr–° F./BTU/in.

K is thermal conductivity of the material in BTU/hour–inch–° F.

L is the thickness of the material as measured in inches along an axis parallel to the heat flow.

A is the area of the material as measured in square inches along an axis transverse to the heat flow/in. of perimeter.

The thermal resistance for components of an edge assembly that lie in a line substantially perpendicular or normal to the major surface of the unit is determined by equation (5).

$$S=R_1+R_2+\ldots+R_n \quad (5)$$

where S and R are as previously defined.

In those instances where the components of an edge assembly lie along an axis parallel to the major surface of the unit, the thermal resistance (S) is defined by the following equation (6).

$$S=\frac{1}{\frac{1}{R_1}+\frac{1}{R_2}+\cdots+\frac{1}{R_n}} \quad (6)$$

where R is as previously defined.

Combining equations (3), (5) and (6) the resistance of the edge of the unit 150 shown in FIG. 10 to heat flow may be determined by following equation (7).

$$RHL=R_{12}+R_{14}+2R_{154}+2R_{156}+\frac{1}{\frac{1}{R_{157}}+\frac{1}{R_{160}}+\frac{1}{R_{155}}} \quad (7)$$

where

RHL is as previously defined, $R_{12}$ and $R_{14}$ are the thermal resistance of the glass sheets, $R_{154}$ is the thermal resistance of the adhesive layer 154, $R_{155}$ is the thermal resistance of the adhesive layer 155, $R_{156}$ is the thermal resistance of the outer legs 156 of the spacer 158, $R_{157}$ is the thermal resistance of the middle leg 157 of the spacer 158, and $R_{160}$ is the thermal resistance of the adhesive layer 160.

Although equation (7) shows the relation of the components to determine edge resistance to heat loss, Equation 7 is an approximate method used in standard engineering calculations. Computer programs are available which solve the exact relations governing heat flow or resistance to heat flow through the edge of the unit.

One computer program that is available is the thermal analysis package of the ANSYS program available from Swanson Analysis Systems Inc. of Houston, Pa. The ANSYS program was used to determine the resistance to edge heat loss or U-value for units similar to those shown in FIGS. 1–4.

The edge U-value, defined previously, while being a measure of the overall effect demonstrating the utility of the invention is highly dependent on certain phenomena that are not limiting to the invention such as film coefficients, glass thickness and frame construction. The discussion of the edge resistance of the edge assembly (excluding the glass sheets) will now be considered. The edge resistance of the edge assembly is defined by the inverse of the flow of heat that occurs from the interface of the glass and sealant layer 154 at the inside side of the unit to the interface of glass and sealant layer 154 at the outside side of the unit per unit increment of temperature, per unit length of edge assembly perimeter. The glass sealant interfaces are assumed to be isothermal to simplify the discussion. Support for the above position may be found, among other places, in the paper entitled Thermal Resistance Measurements of Glazing System Edge-Seals and Seal Materials Using a Guarded Heater Plate Apparatus written by J. L. Wright and H. F. Sullivan ASHRAE TRANSACTIONS 1989, V.95, Pt.2.

In the following discussion and in the claims, a parameter of interest is the resistance to heat flow of the edge assembly per unit length of perimeter ("RES").

As mentioned above, the ANSYS finite element code was used to determine the RES. The result of the ANSYS calculation is dependent on the assumed geometry of the cross section of the edge assembly and the assumed thermal conductivity of the constituents thereof. The geometry of any such cross section can easily be measured by studying the unit edge assembly. The thermal conductivity of the constituents or the edge assembly RES value can be measured as shown in ASHRAE TRANSACTIONS identified above. The following thermal conductivity values for edge assembly materials are given in the article. Additional values may be found in Principles of Heat Transfer 3rd ed. by Frank Kreith.

| Material | Thermal Conductivity |
|---|---|
| Butyl | .24 W/mC (.011 BTU/hr-in-° F.) |
| Silicone | .36 W/mC (.017 BTU/hr-in-° F.) |
| Polyurethene | .31 W/mC (.014 BTU/hr-in-° F.) |
| 304 stainless steel | 13.8 W/mC (.667 BTU/hr-in-° F.) |
| Aluminum | 202. W/mC (9.75 BTU/hr-in-° F.) |

Let us now consider the RES calculated for edge assemblies of the units of FIGS. 1–4. The construction of the edge assembly 16 of the unit 10 of FIG. 1 included a hollow aluminum spacer 20 between the glass sheets; the spacer had a wall thickness of about 0.025 inch (0.06 centimeter), a side length perpendicular to the major surface of the glass sheets 12 and 14 of about 0.415 inch (1.05 centimeters), and a side length generally parallel to the major surface of the glass sheets 12 and 14 of about 0.3 inch (0.76 centimeter); adhesive layers 24 of butyl having a thickness of about 0.003 inch (0.008 centimeter); and a silicone structural seal 16 filling the cavity formed by the spacer 20 and glass sheets 12 and 14. The edge assembly RES-value of the unit (10) constructed as above discussed using the ANSYS program was calculated to be 4.65 hr–° F./BTU per inch of perimeter.

The construction of the edge assembly 32 of the unit 30 of FIG. 2 included a pair of glass sheets spaced about 0.423 inch (1.07 centimeters) apart; an edge wall designated by number 32 having a thickness of about 0.090 inch (0.229 centimeter). The edge assembly RES-value of the unit 30 constructed as described above using the ANSYS program was calculated to be 104 hr–° F./BTU per inch of perimeter.

The construction of the edge assembly 52 of the unit 50 of FIG. 3 included a pair of glass sheets 12 and 14 spaced about 0.50 inch (1.27 centimeters) apart; a desiccant filled foam structural member about 0.25 inch (0.64 centimeter) thick adhered to the glass surfaces; an aluminum coated plastic diffusion barrier and a butyl edge seal about 0.25 inch (0.64 centimeter) thick. The aluminum coating between the foam member and seal was too thin for accurate measurement. The edge assembly RES-value of the unit 50 constructed as above described using the ANSYS program was calculated to be 104.0 hr–° F./BTU per inch of perimeter.

A unit similar to the unit 50 of FIG. 3 having a pair of glass sheets 12 and 14 spaced 0.45 inch (1.143 centimeters) apart; an adhesive layer 54 of silicone having a thickness of about 0.187 inch (0.475 centimeter) with desiccant therein; a moisture impervious sealant 58 of butyl having a thickness of about 0.187 inch (0.475 centimeter) is expected using the ANSYS program to have an edge assembly RES-value using the ANSYS program of about 84.7 hr–° F./BTU per inch of perimeter. A comparison of the edge assembly RES-value for the different constructions of units of the type shown in FIG. 3 are given to show the effect material changes and dimensions have on the edge assembly RES-value.

The construction of the edge assembly of the unit 70 of FIG. 4 included a pair of glass sheets spaced about 0.45 inch (1.143 centimeters) apart; an adhesive butyl edge seal about 0.312 inch (0.767 centimeter) wide with a desiccant and an aluminum spacer about 0.010 inch (0.025 centimeter) thick imbedded therein. The edge assembly RES-value of the unit 70 constructed as above described using the ANSYS program was calculated to be 4.50 hr–° F./BTU per inch of perimeter.

The construction of the edge assembly 150 of the instant invention shown in FIG. 10 included a pair of glass sheets spaced about 0.47 inch (1.20 centimeters) apart; a polyisobutylene layer 154 which is moisture and argon impervious had a thickness of about 0.010 inch (0.254 centimeter) and a height as viewed in FIG. 10 of about 0.250 inch (0.64 centimeter); a 304 stainless steel U-shaped channel 156 had a thickness of about 0.007 inch (0.018 centimeter), the middle or center leg had a width as viewed in FIG. 10 of about 0.430 inch (1.09 centimeters) and outer legs each had a height as viewed in FIG. 10 of about 0.250 inch (0.64 centimeter); a desiccant impregnated polyurethane layer 160 had a height of about 0.125 inch (0.32 centimeter) and a width as viewed in FIG. 10 of about 0.416 inch (1.05 centimeters); a polyurethane secondary seal 155 had a width of about 0.450 inch (1.143 centimeters) and a height of about 0.125 inch (0.32 centimeter) as viewed in FIG. 10. The edge assembly RES-value of the unit 150 constructed as above described using the ANSYS program was calculated to be 79.1 hr–° F./BTU per inch of perimeter.

Figure 11:
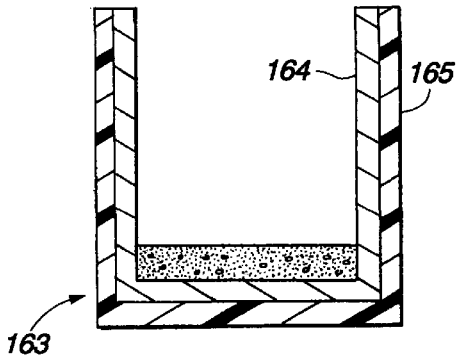
FIG. 11 is a cross section of another embodiment of a spacer of the instant invention.

Shown in FIG. 11 is the cross sectional view of another embodiment of a spacer of the instant invention. Spacer 163 has a structurally resilient core. The core in the practice of the invention may be non-metal and is preferably a polymeric core e.g. fiberglass reinforced plastic U-shaped member 164 having a thin film 165 of insulating gas impervious material. For example when air, argon or krypton is used in the compartment, the thin film 165 may be metal. The structure of the spacer as well as the gas barrier film are chosen so that the unit will contain the fill gas for the desired unit lifetime. A spacer according to FIG. 11 using argon as a fill gas and employing polyvinylidene chloride as the barrier film, the preferred thickness of the polyvinylidene chloride will be at least 5 mils and more preferably it will be greater than 10 mils.

If a material other than polyvinylidene chloride is used as the barrier film, the proper thickness to retain the fill gas for the desired unit lifetime may be adjusted depending on the material's gas containment characteristics.

The fill gas retention characteristics of the unit according to the instant invention is measured by the above referred DIN 52293.

For argon, the film 165 may be a 0.0001 inch (0.000254 centimeter) thick aluminum film or a 0.005 inch thick film of polyvinylidene chloride. As used herein the argon impervious material has a permeability to argon of less than 5%/yr. The invention contemplates having a core 164 and a thin layer of film 165 or several layers 164 and 165 to build up a laminated structure. Using the spacer 163 having the aluminum film in place of the spacer 155 of the unit 150 in FIG. 10 the edge assembly RES-value for the unit 150 of FIG. 10 is expected to be about 120. This is about a 50% increase in the RES-value by changing the spacer to a thinly metal cladded plastic spacer. Using the spacer 163 having a polyvinylidene chloride film of a thickness of 0.005 inch, the edge assembly RES-value of the unit 150 of FIG. 10 is also expected to be about 120.

The instant invention also contemplates having a spacer 163 of FIG. 11 whose body is made entirely from a polymeric material having moisture/gas impervious characteristics. Such a spacer body may be reinforced (e.g. fiberglass reinforced) but would not include any film barrier (i.e. the spacer 163 would not include a thin film 165). Such a polymeric material would preferably be a halogenated polymeric material including polyvinylidene chloride, polyvinylidene flouride, polyvinyl chloride or polytrichlorofluoro ethylene. The edge assembly of such a spacer 163 made entirely of a polymeric material would have a high edge assembly RES-value expected to be comparable to the spacer of FIG. 11.

The spacer of the instant invention, in addition to acting as a barrier to the insulating gas in the compartment 18, is structurally sound. As used herein and in the claims "structurally sound" means the spacer maintains the glass sheets in a spaced relationship while permitting local flexure of the glass due to changes in barometric pressure, temperature and wind load. The feature of maintaining the glass sheets in a fixed spacer relationship means that the spacer prevents the glass sheets from significantly moving toward one another when the edges of the unit are secured in the glazing frame. As can be appreciated less force is applied to the edges of residential units mounted in a wooden frame than to edges of commercial units mounted by pressure glazing in metal curtainwall systems. Permitting local flexure means the spacer allows rotation of the marginal edge portions of the glass about its edge during loading of the types described while restricting movement other than rotation i.e. translation. The degree of structural soundness is related to type of material and thickness. For example metal may be thin where plastic to have the same structural soundness must be thicker or reinforced e.g. by fiber glass.

Embodiments of the instant invention may be used to improve the performance of the prior art units. For example replacing the spacer of the unit 10 of FIG. 1 with a stainless steel spacer is expected to increase the edge assembly RES-value from 4.65 to 18.2 hr−° F./BTU per unit of perimeter. If the metal thickness is changed from 0.025 inch (0.06 centimeter) to 0.005 inch (0.0127 centimeter) the edge assembly R-value of the unit 10 of FIG. 1 using the ANSYS program goes from 4.65 to 96.1 hr−° F./BTU per inch of perimeter. Replacing the aluminum strip of the unit in FIG. 4 with a stainless steel strip increases the edge assembly RES from 4.5 to 44.4 hr−° F./BTU per unit of perimeter.

The unit 150 of the instant invention having the spacer assembly 152 shown in FIG. 10 is expected to have an edge heat loss similar to that of line 140. The unit 150 of the instant invention having the spacer assembly 163 shown in FIG. 11 is expected to have an edge heat loss between line 130 and 140 but close to line 130. Although the edge assembly of the instant invention has an edge assembly RES-value less than the RES-value for edge assemblies having organic spacers of the type shown in FIG. 3, the edge assembly of the instant invention has distinct advantages. More particularly, the spacer is metal, gas and moisture impervious plastic, metal cladded plastic core, metal cladded reinforced plastic core, gas moisture impervious film cladded plastic core, gas moisture film cladded reinforced plastic core and is therefore more structurally sound. The diffusion path i.e. the length and thickness of the gas and moisture impervious adhesive sealant material is longer in the unit of the instant invention and therefore for the same type of material filling the diffusion path, the longer, thinner diffusion path of the instant invention reduces the rate of fill gas loss. The argon gas path is longer because it is limited to the adhesive layers 154 (see FIG. 10) whereas in organic spacers the diffusion path is through the entire width of the spacer surface. In the unit of FIG. 3 a metal barrier is provided to reduce argon loss. The metal film coated on the plastic or PVDC coated plastic has a thickness in the range of about 0.001–0.003 inch (0.00254–0.00762 centimeter) which is a short diffusion path. The instant invention has a long diffusion path e.g. greater than about 0.003 inch (0.00762 centimeter) and a thin diffusion path e.g. less than about 0.0125 inch (0.32 centimeter). The unit shown in FIG. 10 has a diffusion path length of about 0.250 inch (0.64 centimeter) and a diffusion path thickness of about 0.010 inch (0.254 centimeter). The path length can be increased by increasing the height of the legs of the spacer and the path thickness decreased by decreasing the spacing between the legs of the spacer and adjacent glass sheet.

In actual tests a unit having an edge assembly of the instant invention and a unit having the edge assembly shown in FIG. 3 had essentially identical RES values. It is believed that the bead on the interior of the spacer may have insulated the spacer from convection cooling by the gases in the compartment.

As was discussed the teachings of the invention may be used to increase edge assembly RES-value of a unit by using the spacer shown in FIG. 11. Shaping a fiberglass reinforced plastic core 164 and then sputtering a thin film 165 of aluminum or adhering in any convenient manner a gas/moisture impervious film such as a PVDC film prevents the egress of argon limiting the path essentially to the sealant or adhesive between the spacer and glass as was discussed for the unit 150 of FIG. 10.

As can now be appreciated the unit of the instant invention provides an edge assembly having a metal spacer, a metal coated plastic spacer or a plastic spacer or a multi-layered plastic spacer that retain insulating gas other than air, e.g. argon, has a relatively high edge assembly RES-value or low U-value and has structural soundness.

The discussion will now be directed to the U-value of the frame of the unit. The frame also conducts heat and in certain instances e.g. metal frames conduct sufficiently more heat than the edge assembly of the unit such that the edge heat loss through the frame overshadows any increase in thermal resistance to heat loss provided at the edge of the unit. Wooden frames, metal frames with thermal breaks or plastic frames have high resistance to heat loss and the performance of the edge heat loss of the unit would be more dominant.

The invention is not limited to units having two sheets but may be practiced to make units having two or more sheets e.g. unit 250 shown in FIG. 20.

The discussion will now be directed to a method of fabricating the glazing unit of the instant invention. As will be appreciated the unit of the instant invention may be fabricated in any manner; however, the construction of the unit is discussed using selected ones of the edge assembly components taught in U.S. patent application Ser. No. 07/578,697 filed Sep. 4, 1990, in the names of Stephen C. Misera and William R. Siskos and entitled A SPACER AND SPACER FRAME FOR AN INSULATING GLAZING UNIT AND METHOD OF MAKING SAME which teachings are hereby incorporated by reference.

Figure 12:
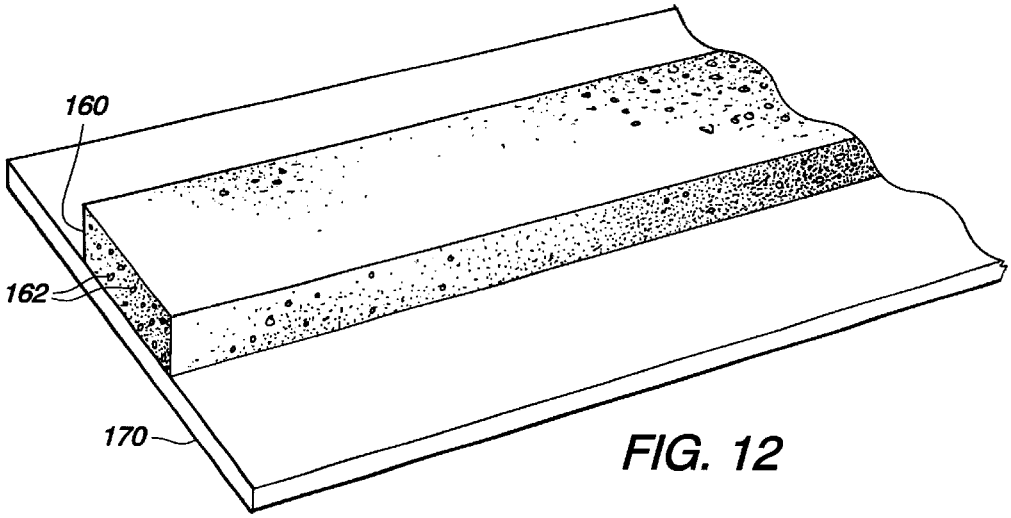
FIG. 12 is a view of an edge strip incorporating features of the invention having a bead of a moisture and/or gas pervious adhesive having a desiccant.

With reference to FIG. 12, there is shown an edge strip 169 having a substrate 170 having the bead 160 of moisture pervious adhesive having the desiccant 162 mixed therein. In the preferred practice of the invention the substrate is made of a material, e.g. metal or composite of plastic as previously described, that is moisture and gas impervious to maintain the insulating gas in the compartment and prevent the ingress of moisture into the compartment, and has structural integrity and resiliency to maintain the glass sheets in spaced relation to one another and yet accommodates a certain degree of thermal expansion and contraction which typically occurs in the several component parts of the insulating glazing unit. In the practice of the invention, the substrate was made of 304 stainless steel having a thickness of about 0.007 inch (0.0178 centimeter) thick, a width of about 0.625 inch (1.588 centimeters) and a length sufficient to make spacer frame to be positioned between glass sheets e.g. a 24-inch (0.6 meter) square shaped unit. The bead 160 is a polyurethane having a desiccant mixed therein. A bead about ⅛ inch (0.32 centimeter) high and about ⅜ inch (0.96 centimeter) wide is applied to the center of the substrate 170 in any convenient manner.

As can be appreciated the desiccant bead may be any type of adhesive or polymeric material that is moisture pervious and can be mixed with a desiccant. In this manner the desiccant can be contained in the adhesive or polymer material and secured to the substrate while having communication to the compartment. Types of materials that are recommended, but the invention is not limited thereto, are polyurethanes and silicones. Further the bead may be the spacer dehydrator element taught in U.S. Pat. No. 3,919,023 which teachings are hereby incorporated by reference.

Further, as can now be appreciated one or both sides of one or more sheets may have an environmental coating such as the one taught in U.S. Pat. Nos. 4,610,771; 4,806,220; 4,853,256; 4,170,460; 4,239,816 and 4,719,127 which patents are hereby incorporated by reference.

In the practice of the invention the metal substrate after forming into spacer stock and the bead has sufficient structural strength and resiliency to keep the sheets spaced apart and yet accommodates a certain degree of thermal expansion and contraction which typically occurs in the several component parts of the insulating glazing unit. In one embodiment of the invention the spacer is more structurally stable than the bead i.e. the spacer is sufficiently structurally stable or dimensionally stable to maintain the sheets spaced from one another whereas the bead cannot. In another embodiment of the invention both the spacer and the bead can. For example, the bead may be a desiccant in a preferred spacer taught in U.S. Pat. No. 3,919,023 to Bowser. As can be appreciated by those skilled in the art, a metal spacer can be fabricated through a series of bends and shaped to withstand various compressive forces. The invention relating to the bead 160 carried on the substrate 170 is defined by shaping the substrate 170 into a single walled U-shaped spacer stock with the resultant U-shaped spacer stock being capable of withstanding values of compressive force to maintain the sheets apart regardless of the structural stability of the bead. As can be appreciated by those skilled in the art the measure and value of compressive forces and structural stability varies depending on the use of the unit. For example if the unit is secured in position by clamping the edges of the unit such as in curtainwall systems, the spacer has to have sufficient strength to maintain the glass sheet apart while under compressive forces of the clamping action. When the use is mounted in a rabbit of a wooden frame and caulking applied to seal the unit in place, the spacer does need as much structural stability to maintain the glass sheets apart as does a spacer of a unit that is clamped in position.

The edges of the strip 150 are bent in any convenient manner to form outer legs 156 of a spacer 158 shown in FIG. 10. For example the strip 170 may be pressed between bottom and top rollers as illustrated in FIGS. 13–16.

Figure 13:
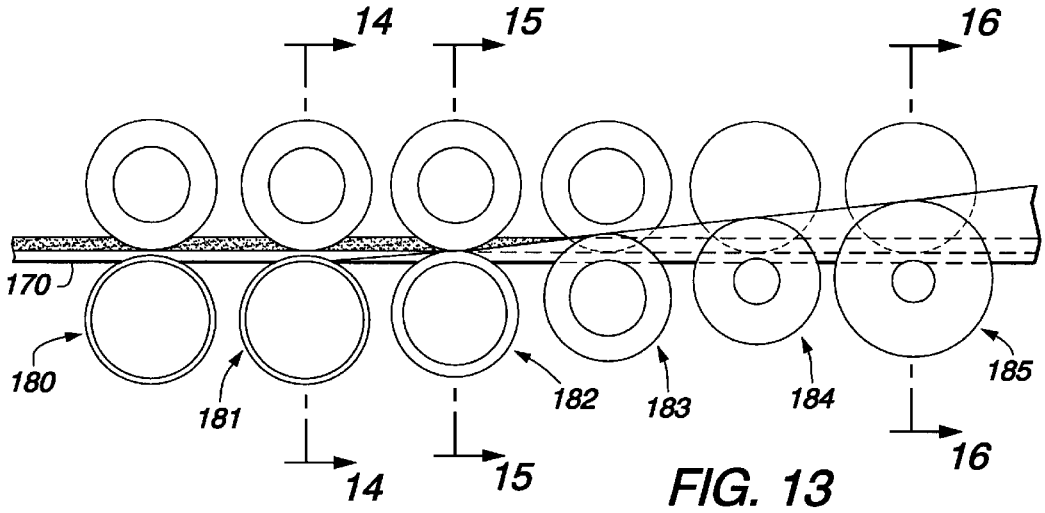
FIG. 13 is a side elevated view of a roll forming station to form the edge strip of FIG. 12 into spacer stock incorporating features of the instant invention.
Figure 14:
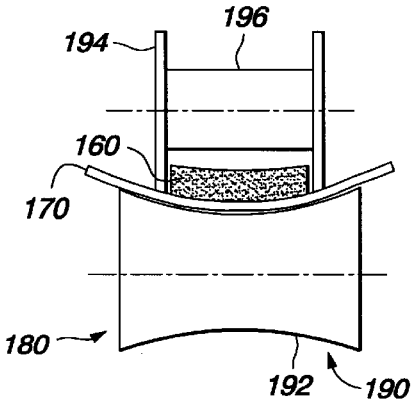
FIGS. 14 thru 16 are views taken along lines 14 thru 16 respectively of FIG. 13.
Figure 15:
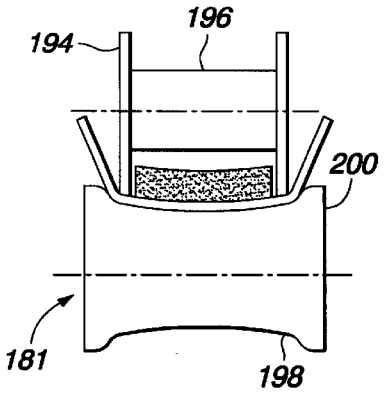

With reference to FIG. 13 the strip is advanced from left to right between roll forming stations 180 thru 185. As will be appreciated by those skilled in the art, the invention is not limited to the number of roll forming stations or the number of roll forming wheels at the stations. In FIG. 14 the roll forming station 180 includes a bottom wheel 190 having a peripheral groove 192 and an upper wheel 194 having a peripheral groove 196 sufficient to accommodate the bead 160. The groove 192 is sized to start the bending of the substrate 170 to a U-shaped spacer and is less pronounced than groove 198 of the bottom wheel 200 of the pressing station 181 shown in FIG. 15 and the remaining bottom wheels of the downstream pressing station 182 thru 185.

Figure 16:
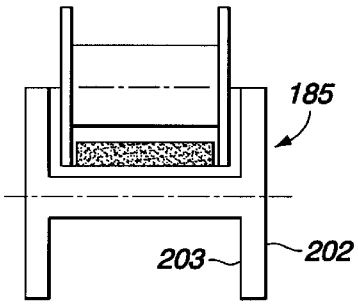

With reference to FIG. 16, the lower wheel 202 of the roll forming station 185 has a peripheral groove 203 that is substantially U-shaped. The spacer stock exiting the roll forming station 185 is the U-shaped spacer 158 shown in FIG. 10.

As can now be appreciated the grooves of the upper roll forming wheels may be shaped to shape the bead of material on the substrate.

In the practice of the invention the bead 160 was applied after the spacer stock was formed e.g. the substrate formed into a U-shaped spacer stock. This was accomplished by pulling the substrate through a die of the type known in the art to form a flat strip into a U-shaped strip.

As can be appreciated, everything else being equal, loose desiccant is a better thermal insulation than desiccant in a moisture pervious material. However, handling and containing loose desiccant in a spacer in certain instances is more of a limitation than handling desiccant in a moisture pervious matrix. Further having the desiccant in a moisture pervious matrix increases the shelf life because the desiccant takes a longer period of time to become saturated when in a moisture and/or gas pervious material as compared to being directly exposed to moisture. The length of time depends on the porosity of the material. However, the invention contemplates both the use of loose desiccant and desiccant in a moisture pervious matrix.

Figure 17:
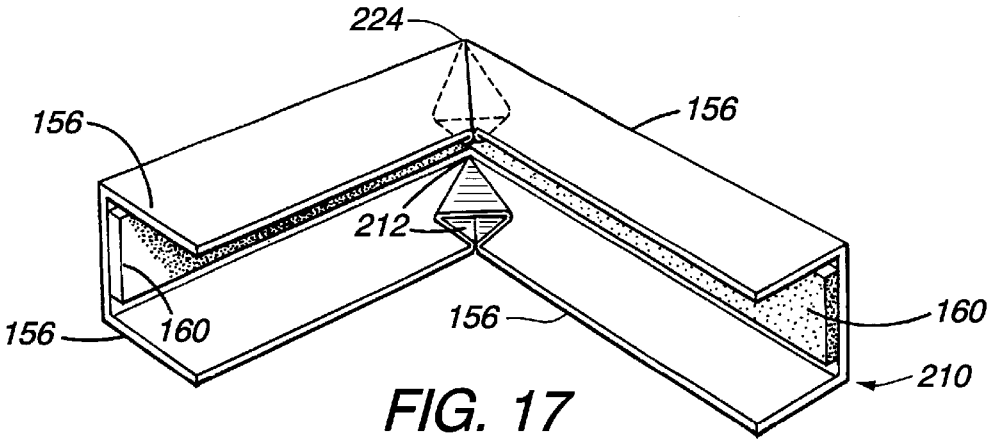
FIG. 17 is a view of a continuous corner of a spacer frame of the instant invention made using the spacer section shown in FIG. 18.
Figure 19:
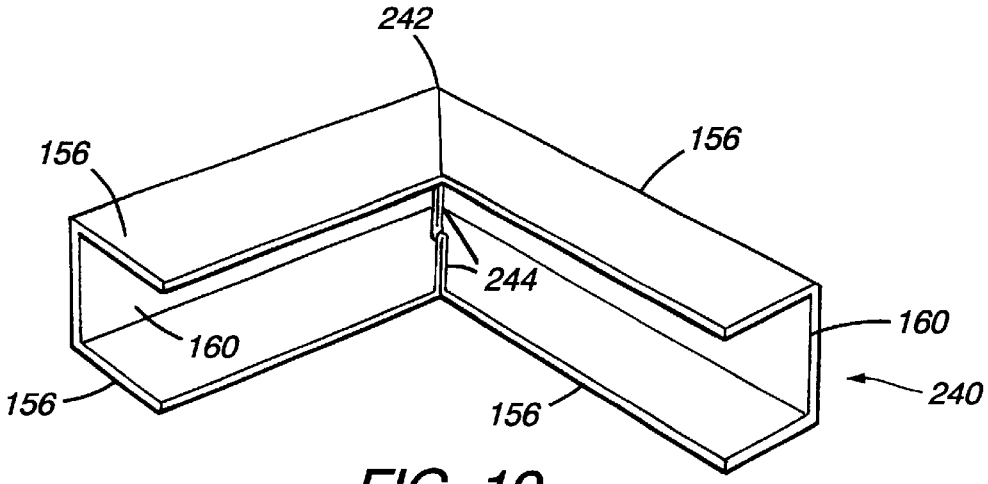
FIG. 19 is a view similar to the view of FIG. 18 illustrating another continuous corner of a spacer frame incorporating features of the invention.

The spacer stock 158 may be formed into a spacer frame for positioning between the sheets. As can be appreciated, the layers 154 and 155, shown in FIG. 10 may be applied to the spacer stock or the spacer frame. The invention is not limited to the materials used for the layers 154 and 155; however, it is recommended that the layers 154 provide high resistance to the flow of insulating gas in the compartment 18 between the spacer 152 and the sheets 12 and 14. The layer 155 may be of the same material as layers 154 or a structural type adhesive e.g. silicone. Before or after the layers 154 and/or 155 are applied to the spacer stock, a piece of the spacer stock is cut and bent to form the spacer frame. Three corners may be formed i.e. continuous corners and the fourth corner welded or sealed using a moisture and/or gas impervious sealant. Continuous corners of spacer frame incorporating features of the invention are shown in FIGS. 17 and 19. However, as can be appreciated, spacer frames may be formed by joining sections of the spacer stock and sealing the edges with a moisture and/or gas impervious sealant or welding the corners together.

Figure 18:
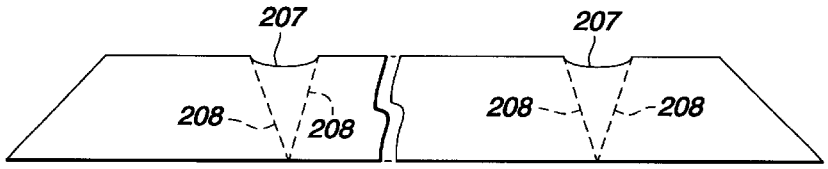
FIG. 18 is a partial side view of a section of spacer stock notched and creased prior to bending to form the continuous corner of the spacer frame shown in FIG. 17 in accordance to the teachings and incorporating features of the inventions.

With reference to FIG. 18 a length of the spacer stock having the bead is cut and a notch 207 and creases 208 are provided in the spacer stock in any convenient manner at the expected bend lines. The area between the creases is depressed e.g. portion 212 of the outer legs 156 at the notch are bent inwardly while the portions on each side of the crease are biased toward each other to provide a continuous overlying corner 224 as shown in FIG. 17. The non-continuous corner e.g. the fourth corner of a rectangular frame may be sealed with a moisture and/or gas impervious material or welded. As can be appreciated the bead at the corner may be removed before forming the continuous corners.

With reference to FIG. 19, in the practice of the invention spacer frame 240 was formed from a U-shaped spacer stock. A continuous corner 242 was formed by depressing the outer legs of the spacer stock toward one another while bending portions of the spacer stock about the depression to form a corner e.g. 90° angle. As the portions of the spacer stock are bent the depressed portions 244 of the outer legs move inwardly toward one another. After spacer frame was formed, layers of the sealant were provided on the outer surface of the legs 18 of the spacer frame and the bead 26 on the inner surface of the middle leg of the spacer frame. The unit 10 was assembled by positioning and adhering the glass sheets to the spacer frame by the sealant layers 154 in any convenient manner.

A layer 155 of an adhesive if not previously provided on the frame is provided in the peripheral channel of the unit (see FIG. 10) or on the periphery of the unit. Argon gas is moved into the compartment 18 in any convenient manner to provide an insulating unit having a low thermal conducting edge.

As can be appreciated by those skilled in the art, the invention is not limited by the above discussion which was presented for illustrative purposes only.

What is claimed is:

1. A method of fabricating an insulating unit comprising the steps of:

providing a pair of sheets;

providing a substrate;

forming the substrate into at least one spacer section having a base and a pair of outer legs connected to the base, the at least one spacer section having a surface designated as a supporting surface, and having a structural stability sufficient to maintain the pair of sheets spaced from one another;

providing a bead on the supporting surface, the bead provided on the supporting surface includes a moisture pervious adhesive having a desiccant therein, the bead at least when provided on the supporting surface having a structural stability to maintain the pair of sheets spaced from one another less than the structural stability of the spacer section, and assembling a spacer frame that includes the at least one spacer section and the sheets to provide an insulating unit having the pair of sheets in a fixed spaced relationship to one another with the spacer frame therebetween to provide a compartment defined by the sheets and portions of the spacer frame wherein the moisture pervious adhesive having the desiccant communicates with the compartment.

2. The method according to claim 1 wherein:

said step of providing a pair of sheets includes the step of providing the pair of sheets each having a parallelepiped shape, and said step of providing means for spacing includes the step of providing a closed parallelepiped frame including the at least one section.

3. The method according to claim 2 wherein the step of assembling includes flowing a moisture impervious adhesive on selected portions of the spacer frame and moving the sheets and spacer frame relative to one another to move the adhesive into contact with edge portions of the glass sheets.

4. The method according to claim 1 wherein said step of assembling includes the step of providing three spacer sections, each of the three sections having a pair of outer legs connected to a base to provide the sections with a U-shaped cross sectional configuration with outer legs of the three spacer sections and of the at least one spacer section only connected by the base, the step of providing the adhesive having the desiccant is practiced on each of the three sections and the at least one spacer section by flowing the adhesive having the desiccant on the surface of the base between the upright legs; and providing a moisture impervious adhesive on outer surface of each of the upright legs of the spacer frame.

5. The method according to claim 4 wherein the assembling step includes the step of positioning the spacer frame on marginal edge portions of one of the sheets and the marginal edge portions of the other sheet on the opposite side of the spacer frame.

6. The method according to claim 4 wherein the spacer sections are made of a fiber reinforced fiber glass plastic core with a film of a gas and moisture impervious film.

7. The method according to claim 4 wherein the spacer sections are made of a plastic core coated with a film of a gas and moisture impervious film.

8. The method according to claim 6 wherein the film is a halogenated polymeric material.

9. The method according to claim 7 wherein the film is a thin metallic film.

10. The method according to claim 4 wherein the spacer sections are made of metal.

11. The method of claim 1 wherein the step of providing a bead on the supporting surface includes flowing the bead on the supporting surface.

12. The method of claim 1 wherein the bead after it is provided on the support surface and during the use of the unit has a structural stability less than that of the spacer section.

13. A method of fabricating an insulating unit comprising the steps of:

providing a pair of sheets;

providing a substrate;

providing a length of spacer stock having a base and a pair of outer legs connected to the base with the outer legs having cutouts indicating bending points of the spacer stock the spacer stock having a surface designated as a supporting surface between the outer legs, and having a structural stability sufficient to maintain the pair of sheets spaced from one another;

providing a bead on the supporting surface, the bead including a moisture pervious adhesive having a desiccant therein, the bead at least when provided on the supporting surface having a structural stability to maintain the pair of sheets spaced from one another less than the structural stability of the spacer section, and bending the spacer stock at the cutouts to form a spacer frame, assembling the spacer frame and the pair of sheets to provide an insulating unit having the pair of sheets in a fixed spaced relationship to one another with the spacer frame therebetween to provide a compartment defined by the sheets and portions of the spacer frame wherein the moisture pervious adhesive having the desiccant communicates with the compartment.

14. The method according to claim 13 further including the step of imposing "V" shaped weaking lines in each of the outer legs about each of the cutouts with closed end of the "V" adjacent to the base, the "V" shaped weaking lines facilitating bending of the spacer stock into the spacer frame during the practice of the bending step.

15. The method according to claim 13 wherein the spacer stock is made of a fiber reinforced fiber glass plastic core with a film of a gas and moisture impervious film.

16. The method according to claim 13 wherein the spacer stock is made of a plastic core coated with a film of a gas and moisture impervious film.

17. The method according to claim 16 wherein the film is a halogenated polymeric material.

18. The method according to claim 16 wherein the film is a thin metallic film.

19. The method according to claim 13 wherein the spacer stock is made of metal.

20. A method of fabricating an insulating unit comprising the steps of:

providing a pair of sheets;

providing a substrate;

forming the substrate into at least one spacer section having at least a base and a pair of outer legs connected to the base, the at least one spacer section having a surface designated as a supporting surface having the pair of outer legs spaced from one another a sufficient distance for air to move between the legs, and having a structural stability sufficient to maintain the pair of sheets spaced from one another;

applying a bead on the supporting surface, the bead includes a moisture pervious adhesive having a desiccant therein, the bead at least when applied having a structural stability to maintain the pair of sheets spaced from one another less than the structural stability of the spacer section, and assembling a spacer frame that includes the at least one spacer section and the pair of sheets to provide an insulating unit having the pair of sheets in a fixed spaced relationship to one another with the spacer frame therebetween to provide a compartment therebetween wherein atmosphere in the compartment moves through the spaced distance between the pair of legs to communicate with the moisture pervious adhesive having the desiccant.

21. The method according to claim 20 wherein:

said step of providing a pair of sheets includes the step of providing a pair of glass sheets, and said step of assembling a spacer frame includes the step of providing a closed spacer frame.

22. The method according to claim 21 wherein the step of assembling a spacer frame includes flowing a moisture impervious adhesive on selected outer surface portions of the spacer frame and moving the sheets and spacer frame relative to one another to move the adhesive into contact with marginal edge portions of the glass sheets.

23. The method according to claim 20 wherein said step of assembling a spacer frame includes providing three spacer sections, each of the three sections having a pair of outer legs connected to a base to provide the sections with a U-shaped cross sectional configuration with outer legs of the three spacer sections and of the at least one spacer section only connected by the base, the step of applying the adhesive having the desiccant is practiced on each of the three sections and the at least one spacer section by flowing the adhesive having the desiccant on surface portions of the base between the upright leg, and further including the step of providing a moisture impervious adhesive on outer surface portions of each of the upright legs of the spacer frame.

24. The method according to claim 20 wherein said step of providing at least one spacer section includes providing a length of spacer stock with the outer legs having cutouts indicating bending points of the spacer stock to form the spacer frame during practice of the assembling step; the step of applying the adhesive containing desiccant is practiced on the surface of the base between the outer legs; and the assembling step includes the step of bending the spacer stock at the cutouts to form the spacer frame.

25. The method according to claim 24 further including the step of imposing "V" shaped weaking lines in each of the outer legs about each of the cutouts with closed end of the "V" adjacent to the base, the "V" shaped weaking lines facilitating bending of the spacer stock into the spacer frame during the practice of the bending step.

26. The method of claim 20 wherein the step of applying a bead on the supporting surface includes flowing the bead on the supporting surface.

27. The method of claim 20 wherein the bead after it is provided on the supporting surface and during the use of the unit has a structural stability less than that of the spacer stock.

28. The method of claim 20 wherein the applying step is practiced during the forming step and the moisture impervious adhesive is applied on the surface of the substrate.

29. A method of fabricating an insulating unit comprising the steps of:

providing a pair of sheets;

providing a substrate;

applying a bead on a surface of the substrate, the bead including a moisture pervious adhesive having a desiccant therein, forming the substrate having the bead into at least one spacer section having at least a base and a pair of outer legs connected to the base, and having a structural stability sufficient to maintain the pair of sheets spaced from one another whereas the bead at least when applied on the surface of the substrate having a structural stability to maintain the pair of sheets spaced from one another less than the structural stability of the spacer section wherein the bead is on surface portions of the base between the pair of outer legs wherein the outer legs are connected only by the base and the outer legs spaced from one another a sufficient distance for air to move between the outer legs, and assembling a spacer frame that includes the at least one spacer section and the pair of sheets to provide an insulating unit having the pair of sheets in a fixed spaced relationship to one another with the spacer frame therebetween to provide a compartment therebetween wherein atmosphere in compartment moves through the spaced distance between the pair of legs to communicate with the moisture pervious adhesive having the desiccant.

30. The method according to claim 29 wherein the step of assembling includes flowing a moisture impervious adhesive on selected portions of the spacer frame and moving the pair of sheets and the spacer frame relative to one another to move the adhesive into contact with marginal edge portions of the glass sheets.

31. The method according to claim 30 wherein said step of providing at least one spacer section includes providing a length of spacer stock with the outer legs having cutouts indicating bending points of the spacer stock to form the spacer frame during practice of the assembling step; the step of providing the adhesive containing desiccant is practiced on the surface of the base between the outer legs; and the assembling step includes the step of bending the spacer stock at the cutouts to form the spacer frame.

32. The method according to claim 30 further including the step of imposing "V" shaped weaking lines in each of the outer legs about each of the cutouts with closed end of the "V" adjacent to the base, the "V" shaped weaking lines facilitating bending of the spacer stock into the spacer frame during the practice of the bending step.

33. The method of claim 29 wherein the step of applying the bead includes flowing the bead on the supporting surface.

34. The method of claim 29 wherein the bead after it is applied on the support surface and during the use of the unit has a structural stability less than that of the spacer section.

* * * * *